United States Patent [19]

Brisco

[11] Patent Number: 4,826,356

[45] Date of Patent: May 2, 1989

[54] PRESSURE ACTUATED FLOW CONTROL VALVE

[75] Inventor: David P. Brisco, Duncan, Okla.

[73] Assignee: Halliburton Company, Duncan, Okla.

[21] Appl. No.: 89,900

[22] Filed: Aug. 27, 1987

[51] Int. Cl.[4] ..... E02B 17/00; F16K 11/00

[52] U.S. Cl. ..... 405/225; 405/227; 137/627; 137/885

[58] Field of Search ..... 405/225, 227, 195, 223, 405/224; 137/627, 885

[56] References Cited

U.S. PATENT DOCUMENTS

| | | | |
|---|---|---|---|
| 3,121,997 | 2/1964 | Sampson . | |
| 3,209,544 | 10/1965 | Borrmann . | |
| 3,213,629 | 10/1965 | Manning . | |
| 3,315,473 | 4/1967 | Hauber et al. . | |
| 3,429,133 | 2/1969 | Hauber . | |
| 3,466,878 | 9/1969 | Esquillan et al. . | |
| 3,564,856 | 2/1971 | Blount et al. . | |
| 3,601,999 | 8/1971 | Olsen et al. . | |
| 3,811,289 | 5/1974 | Bassett . | |
| 3,838,575 | 10/1974 | Clark et al. . | |
| 3,839,872 | 10/1974 | Loire . | |
| 3,878,687 | 4/1975 | Tragesser, Jr. . | |
| 4,009,581 | 3/1977 | Britton et al. . | |
| 4,063,421 | 12/1977 | Coone et al. . | |
| 4,070,869 | 1/1978 | Williams . | |
| 4,077,224 | 3/1978 | Coone . | |
| 4,140,426 | 2/1979 | Knox | 405/225 |
| 4,171,923 | 10/1979 | Landers | 405/225 |
| 4,214,843 | 7/1980 | Rohde | 405/225 |
| 4,240,767 | 12/1980 | Gracia | 405/227 |
| 4,275,974 | 6/1981 | Knox et al. | 405/225 |

FOREIGN PATENT DOCUMENTS

| | | | |
|---|---|---|---|
| 2096674 | 10/1982 | United Kingdom . | |
| 2168407 | 6/1986 | United Kingdom | 405/225 |

OTHER PUBLICATIONS

LTV Energy Products Oil States Industries Division Brochure OSI 623, "Diaphragm Closures".

Halliburton Services Brochure, "Advanced Materials and Techniques Make Halliburton Your Best Choice for Offshore Platform Grouting", published in 1979 by Halliburton Company.

Halliburton Services Flyer SS-103 (Revised) "Unitrol® Manifold".

Halliburton Services Sales and Service Catalog No. 43, pp. 2590 and 2591.

*Primary Examiner*—Randolph A. Reese

*Assistant Examiner*—John Ricci

*Attorney, Agent, or Firm*—James R. Duzan; Neal R. Kennedy

[57] ABSTRACT

A pressure actuated flow control valve for use in conjunction with inflatable packers and grouting systems on offshore oil platforms. The valve includes an elongated body with a plurality of pistons slidably disposed in the body between first and second positions, each piston being positioned adjacent a corresponding discharge port on the body. When in the first position, the piston sealingly closes the corresponding discharge port. When the piston is in the second position, the piston sealingly closes another discharge port adjacent the corresponding discharge port. A plurality of sleeves are annularly positioned around each of the pistons. First and second pressure lines are provided in communication with volumes adjacent opposite ends of pistons such that alternate pressurizing of the first and second pressure lines results in sequential movement of the pistons from the first to second positions. Interaction of the sleeves with the pistons provides that the pistons will only move from the first position to the second position and reverse movement thereof is prevented. An inflation system, a grout system, an offshore platform and a template for a tension leg platform utilizing the pressure actuated flow control valve are also disclosed.

55 Claims, 6 Drawing Sheets

PRESSURE ACTUATED FLOW CONTROL VALVE

BACKGROUND OF THE INVENTION

1. Field Of The Invention

The present invention relates to pressure actuated flow control valves in conjunction with inflatable packers and grouting systems on offshore oil platforms, and more particularly, to a pressure actuated control valve which sequentially inflates a series of packers or sequentially grouts a series of annuli in response to first and second pressure actuating means.

2. Description of the Prior Art

On offshore drilling platforms, it is necessary to secure the legs of the platform to the ocean floor, and a number of methods have been developed to do this. In the typical procedure, a plurality of jacket legs are set on bottom. Each jacket leg is flanked by a plurality of skirt jackets or sleeves which are attached to the jacket leg and set on bottom at substantially the same time. The jacket leg is a structural member of the offshore platform or tower that extends from the sea bottom to the working deck above sea level. The skirt jacket or sleeve is a jacket or sleeve which is structurally attached to the jacket leg, but extends only partially from the sea bottom toward sea level After the jacket leg and skirt sleeves are set on bottom, piles are driven through each into the sea bed. The pile is smaller in diameter so that an annulus is defined therearound. A leg pile is any pile placed through the leg jacket, and a skirt or sleeve pile is any pile placed through the skirt jacket or sleeve.

A similar structure is found on the more recently developed tension leg platforms. With these platforms, a template is positioned on the ocean floor with a floating platform located thereabove. Anchoring members extend from the platform to the template to hold the platform in its operating position. The anchor members are always in tension and allow some side-to-side movement of the platform, although the platform is prevented from rising and falling with the swells in the ocean. The tension leg platform template has a plurality of skirt sleeves. There are no jacket legs. As with a conventional offshore platform, piles are driven into the skirt sleeves such that an annulus is defined between each pile and the corresponding skirt sleeve.

Inflatable packers are positioned in the annulus at the bottom of each jacket leg and skirt sleeve and are inflated once the piles are in place. The inflated packers bridge the gap between the pile and jacket leg or skirt sleeve, sealing the lower end of the annular space formed therebetween. Grout is then pumped into the annular space between the pile and jacket leg or skirt sleeve to fill the annular space and displace the water therein. Generally, the grout enters a few feet above the packer.

In the most common previous method, a separate inflation line for each packer was run from the surface, and two grout lines, a primary and a secondary grout line, were run from the surface to each annular space that was to be grouted. Such a plurality of lines is expensive, and the likelihood of damage to the lines as the platform is set in place is increased because of the number. Also, the amount of time and expense in installing, identifying and testing the lines during construction of the platform is quite high.

One solution to the problem of multiple lines is the Unitrol® manifold grout/inflation system manufactured by Halliburton Services which can reduce the number of surface lines by 50% to 67%. By using an inflation control valve, a single surface inflation line can be used to inflate two packers. A single surface grout line can be used to grout up to three annular spaces by using a sleeve-type grout valve. However, even this system has some limitations. Balls are dropped through the surface grout line to operate the grout valve, and this requires that the surface line must have bends no greater than 30°. Also, each surface line must be pigged prior to setting the platform in place to insure that the balls can reach the grout valves. Further, having one surface grout line to grout three annular spaces still results in a relatively large number of surface lines, although this is a reduction over the previously known methods.

The pressure actuated flow control valve of the present invention solves all of these problems and is designed to use only one surface line, referred to as the main grouting line, for grouting any number of annular spaces and one surface line, referred to as the main inflation line, for inflating any number of packers desired. In fact, by combining the valve used to inflate the packers and the valve used to grout the annular spaces, a single surface line may be used which can be connected to first an inflation source and then a grout supply. The only additional requirements for the control valve of the present invention is that one or two relatively small pressure actuating lines must be run to a pressure source, preferably at the surface. These lines transmit pressure to operate the control valve.

SUMMARY OF THE INVENTION

The pressure actuated flow control valve of the present invention comprises a plurality of valve module apparatus, and each valve module apparatus comprises body means defining a central opening therethrough and having port means in communication with the central opening, piston means slidably disposed in the central opening of the body means and having first and second sealing means thereon with the piston means having a first position wherein the first sealing means sealingly closes the port means and a second position opening the port means, first pressure passageway means in communication with the piston means on a side of the second sealing means whereby a force is applied on the piston means for holding the piston means in the first position, second pressure passageway means in communication with the piston means on an opposite side of the second sealing means whereby a force is applied on the piston means for moving the piston means from the first position to the second position, and means for preventing movement of the piston means from the second to the first position.

The means for preventing movement of the piston means from the second position to the first position preferably comprises sleeve means annularly positioned around the piston means and having inner and outer sealing means thereon for sealingly engaging the piston means and the body means, respectively. The sleeve means has a first position and a second position. The second pressure passageway means is in communication with the sleeve means between the inner and outer sealing means and the first sealing means such that the force for moving the piston means from the first to second position thereof is applied through the sleeve means on the piston means, whereby the piston means is moved from the first position to the second position thereof as the sleeve means is moved from the first position to the second position thereof. When the piston means is in the second position, the second sealing means is preferably disengaged from the body means such that pressure from the first pressure passageway acts downwardly on a differential area on the piston means, holding it in the second position.

After the second sealing means is disengaged from the body means, pressure from the first passageway means applies a force on the sleeve means for moving the sleeve means from the second to the first position thereof, while the piston means remains in the second position thereof.

In the preferred embodiment, the piston means defines shoulder means thereon, and the sleeve means bears against the shoulder means for moving the piston means from the first to the second position as already described.

The apparatus further comprises shear means for holding the piston means in the first position prior to application of pressure through the second pressure passageway means.

Each body means is adapted for connection to a similar body means of an adjacent valve module. The piston means preferably has third sealing means thereon, and a plurality of valve modules are oriented such that the third sealing means on the piston means in one valve module sealingly closes the port means of an adjacent valve module as the piston means is moved from the first position to the second position thereof.

The first and third sealing means on the piston means are substantially the same diameter, and the first and third sealing means are smaller than the second sealing means in the preferred embodiment.

The body means of the plurality of valve modules form at least a portion of an elongated body means for the entire pressure actuated flow valve. The inner and outer sealing means on the sleeve means may be further characterized as a fourth sealing means in each valve module apparatus of the control valve.

The elongated body means of the control valve may further comprise first or lower adapter means having a discharge port thereon and adapted to receive thereon the third sealing means of an adjacent piston means, and further comprising a second or upper adapter means defining an inlet to the central opening of the valve.

An inflation system for inflating a plurality of inflatable packers on an offshore platform may be built in which the system comprises a pressure actuated valve of the invention wherein the discharge ports thereon are in communication with an inflation source, and a plurality of inflation lines providing communication between corresponding packers and discharge ports. The valve thus may be characterized as comprising means for sequentially placing the discharge ports in communication with the inflation source. In this regard, the means for sequentially placing the discharge ports in communication with the inflation source comprises a plurality of piston assemblies in a central passageway of the valve, each piston assembly being movable from a position closing a discharge port to another position opening the discharge port in response to a pressure differential across the piston assembly, and a pressure line provided in communication between the piston assemblies and a pressure source. The inflation lines preferably comprise check valve means for preventing deflation of the packers.

Similarly, a grout system for grouting a plurality of annuli defined between jackets and corresponding piles of an offshore platform leg may be built in which the system comprises a pressure actuated valve of the invention, and a plurality of grout lines providing communication between corresponding annuli and the discharge ports. The valve thus may be characterized as comprising means for sequentially placing the discharge ports in communication with a grout source. The means for sequentially placing a discharge portion in communication with a grout source may be said to comprise a plurality of piston assemblies in a central passageway in the valve, each piston assembly being movable from a position closing a discharge port to another position opening the discharge port in response to a pressure differential across the piston assembly, and a pressure line providing communication between the piston assemblies and a pressure source. Preferably, the grout lines comprise check valve means for preventing reverse flow of grout therethrough.

The inflation system and grout system may be used in the construction of an offshore platform having an above surface platform portion or a template for a tension leg platform. The platform comprises a plurality of jacket legs positioned on a sea floor and a leg pile disposed within each of the jacket legs such that a leg annulus is defined therebetween. Both the platform and template comprise a plurality of skirt sleeves positioned on the sea floor and a sleeve pile disposed within each of the skirt sleeves such that a sleeve annulus is defined therebetween. On the platform, skirt sleeves are attached to each jacket leg. The platform and template further comprise an inflatable packer disposed at the lower end of the corresponding leg annuli and sleeve annuli, an inflation source, a pressure actuated inflation valve means having a plurality of inflation discharge ports thereon and comprising inflation means for sequentially placing the inflation discharge ports in communication with the inflation source, a plurality of inflation lines providing communication between the corresponding packers and the inflation discharge ports, a grout source, a pressure actuated grout valve means having a plurality of grout discharge ports thereon and comprising grout means for sequentially placing the grout discharge ports in communication with the grout source, and a plurality of grout lines providing communication between corresponding annuli and the grout discharge ports.

For both the offshore platform and the template for tension leg platform, the corresponding leg piles and sleeve piles are driven into the sea floor. The jacket legs on the offshore platform extend downwardly from the above surface platform portion to the sea floor. The template on the tension leg platform has only skirt sleeves.

Each of the inflation lines preferably comprises an inflation check valve therein for preventing deflation of the packers, and each of the grout lines comprises a grout check valve therein for preventing the loose flow of grout therethrough.

In one embodiment, the inflation source may be positioned above the surface, such as on the above surface platform portion of the offshore platform, with the platform or template further comprising a main inflation line providing communication between the inflation source and the inflation valve means. The main inflation line may be permanent or of a type which may be disconnected. Similarly, a grout source may be positioned above the surface wherein the platform or template further comprises a main grout line providing communication between the grout source and the grout valve means. The main grout line may also be either permanent or of a disconnectable type. A first pressure source may be used to actuate the inflation valve means, and another pressure source may be used to actuate the grout valve means. However, the pressure sources may be combined into a single pressure source if desired. In one embodiment, one of the pressure sources may be ocean hydrostatic pressure. In still another embodiment, at least one of the pressure sources may be positioned above the ocean surface.

In an alternate embodiment, the inflation valve means and grout valve means may be combined to form a single pressure actuated control valve means adapted for alternate communication with the inflation source and the grout source.

An important object of the invention is to provide a pressure actuated control valve for inflating a series of inflatable packers or grouting a series of volumes such as annular spaces.

Another object of the invention is to provide an inflation system or grout system on an offshore platform utilizing a pressure actuated control valve.

A further object of the invention is to provide an offshore platform or template for a tension leg platform having a pressure actuated inflation valve for inflating inflatable packers in the annular spaces of a leg assembly of the platform or template and a pressure actuated grout valve for sequentially filling the annular spaces above each inflatable packer with grout.

Additional objects and advantages of the invention will become apparent as the following detailed description of the preferred embodiment is read in conjunction with the drawings which illustrate such preferred embodiment.

BRIEF DESCRIPTION OF THE DRAWINGS

FIG. 6 is a cross section taken along lines 6—6 in FIG. 3C.

DESCRIPTION OF THE PREFERRED EMBODIMENT

Figure 1:
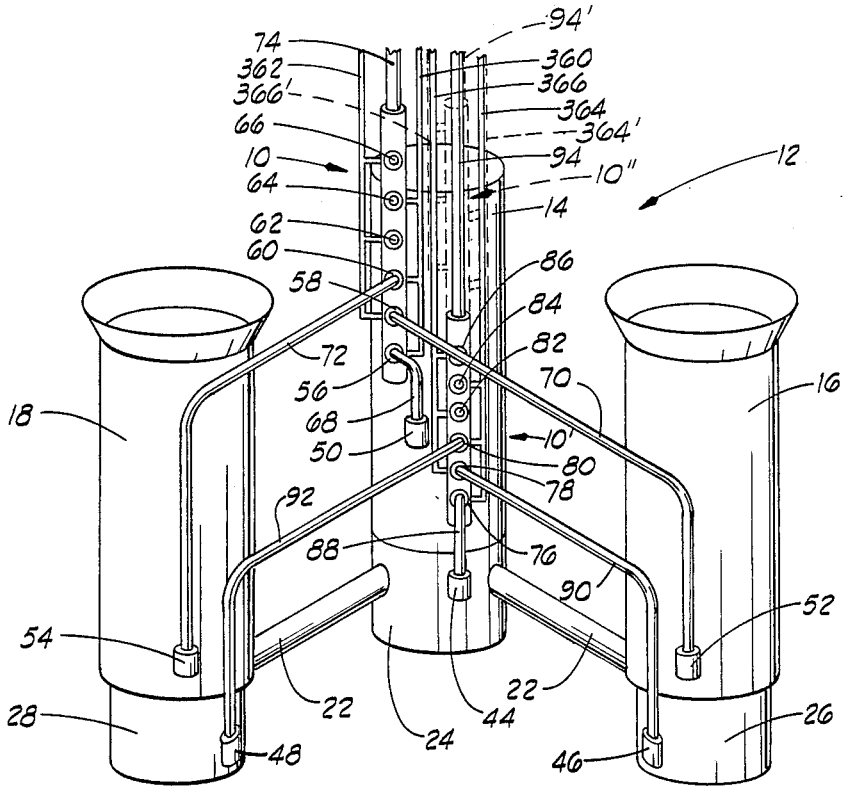
FIG. 1 is a perspective schematic representing a portion of a leg assembly of an offshore platform showing two of the pressure actuated control valves of the present invention for inflating a series of packers and grouting a series of annular spaces.

Referring now to the drawings, and more particularly to FIG. 1, two of the pressure actuated flow control valves of the present invention are shown and generally designated by the numerals 10 and 10'. Valves 10 and 10' are mounted on a leg assembly, generally designated by the numeral 12, of an offshore oil platform. As will be further discussed herein, a tension leg platform template has a similar construction. Other structures such as drilling templates for semisubmersible drilling platforms are also similar.

Leg assembly 12 includes a jacket leg 14 and a plurality of skirt jackets or sleeves, such as 16 and 18. Only two skirt sleeves 16 and 18 have been shown in FIG. 1 for simplicity. However, it should be understood that any number of skirt jacket or sleeves may be used, and normally the number is more than two. Each skirt sleeve 16 or 18 is connected to jacket leg 14 by structural members of a kind known in the art, such as upper strut 20 and lower strut 22. Other connecting and reinforcing members (not shown) may be used as necessary. A tension leg platform template does not have a jacket leg 14, but instead has another skirt sleeve. Other than this, the following discussion relating to an offshore platform is equally applicable to a tension leg platform.

At the lower end of jacket leg 14 is an inflatable packer 24, and at the lower ends of skirt sleeves 16 and 18 are inflatable packers 26 and 28, respectively.

Pressure actuated control valve 10 may also be referred to as grout control valve 10, and pressure actuated control valve 10' may also be referred to as inflation control valve 10'.

Figure 2:
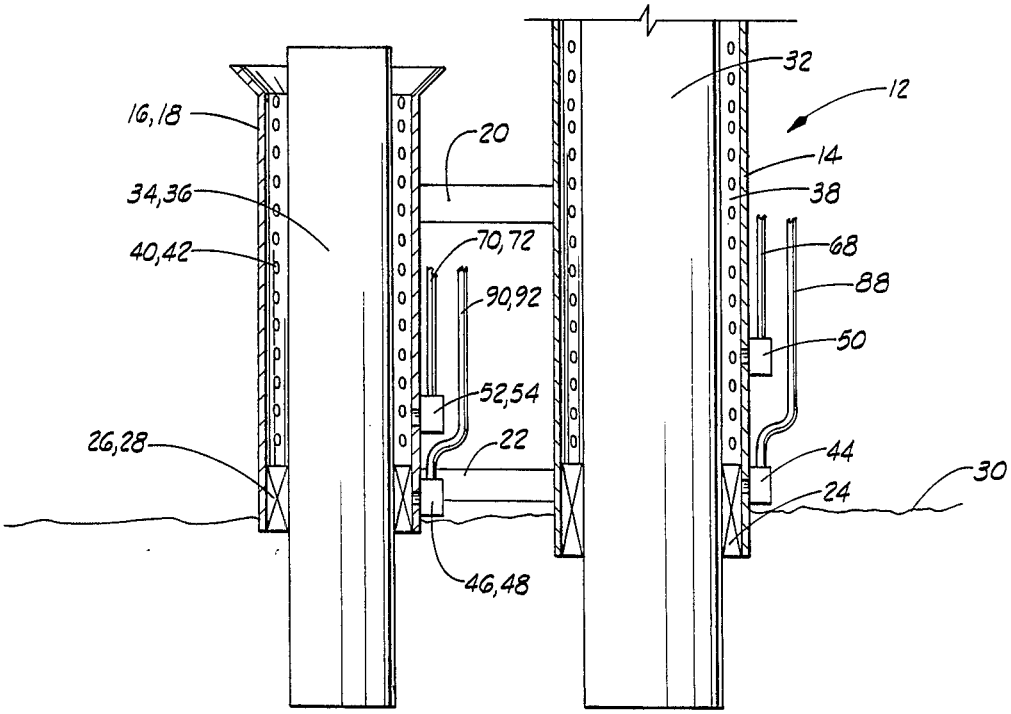
FIG. 2 shows a cross section of one jacket leg and one skirt jacket or sleeve with piles positioned therein and showing the inflated packers and grouted annular spaces.

Referring now to FIG. 2, additional details of leg assembly 12 will be discussed. After leg assembly 12 has been set on a sea floor or bottom 30, a leg pile 32 is positioned within jacket leg 14 and driven into sea floor 30. Similarly, skirt or sleeve piles 34 and 36 are positioned in skirt sleeves 16 and 18, respectively, and also driven into sea floor 30. An annular space 38 is thus formed between jacket leg 14 and leg pile 32 above inflatable packer 24. Similar annular spaces 40 and 42 are defined between skirt sleeve 16 and skirt pile 34 and between skirt sleeve 18 and skirt pile 36, respectively, above corresponding inflatable packers 26 and 28.

Referring again to FIG. 1, inflatable packer 24 preferably has an inflation check valve 44 in communication therewith, and inflation packers 26 and 28 have inflation check valves 46 and 48, respectively, in communication therewith.

Preferably, a grout check valve 50 is in communication with annular space 38, and similar grout check valves 52 and 54 are in communication with annular spaces 40 and 42, respectively.

Inflation and grout check valves as described herein are not required in all cases, but use of them is preferred.

As shown in FIG. 1, grout control valve 10 has port means such as a plurality of discharge ports 56, 58, 60, 62, 64 and 66 thereon. Discharge ports 56, 58 and 60 are connected to grout check valves 50, 52 and 54 by grout lines 68, 70 and 72, respectively. Discharge ports 62, 64 and 66 are adapted to be connected by similar grout lines to grout check valves on other skirt sleeves which are not shown for simplicity.

A main grout line 74 extends from grout control valve 10 to the surface and is connected to a grout supply or source (not shown) of a kind known in the art. Main grout line 74 may be permanently connected to grout control valve 10 as shown in FIG. 1 or of a type which may be disconnected adjacent the control valve.

Inflation control valve 10' has port means such as a plurality of discharge ports 76, 78, 80, 82, 84 and 86 thereon. Discharge ports 76, 78 and 80 are connected by inflation lines 88, 90 and 92 to inflation check valves 44, 46 and 48, respectively. Discharge ports 82, 84 and 86 are adapted to be connected by similar inflation lines to inflatable packers at the lower ends of other skirt sleeves (not shown). A main inflation line 94 extends from inflation control valve 10' to the surface and is connected to an inflation source (not shown) of a kind known in the art. Main inflation line 94 may be permanently connected to control valve 10' as shown in FIG. 1 or of a type which may be disconnected adjacent the control valve.

Figure 3A:
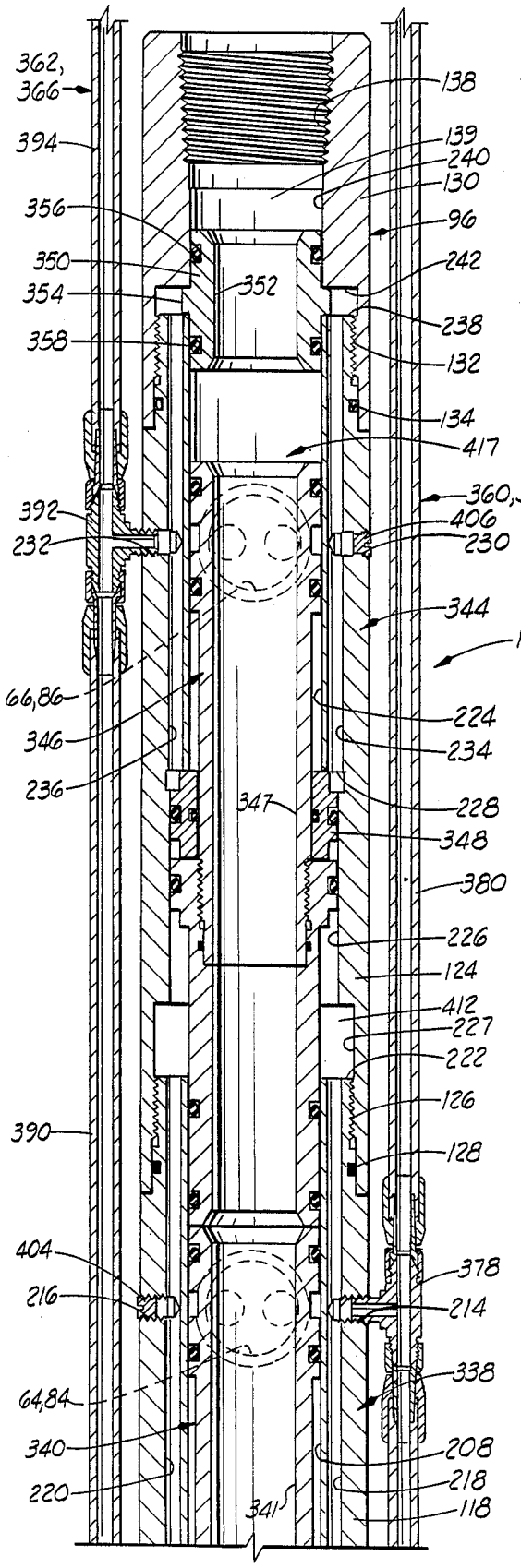
FIGS. 3A–3C show the pressure actuated control valve of the present invention in the original position when the leg assembly is set on bottom.
Figure 3B:
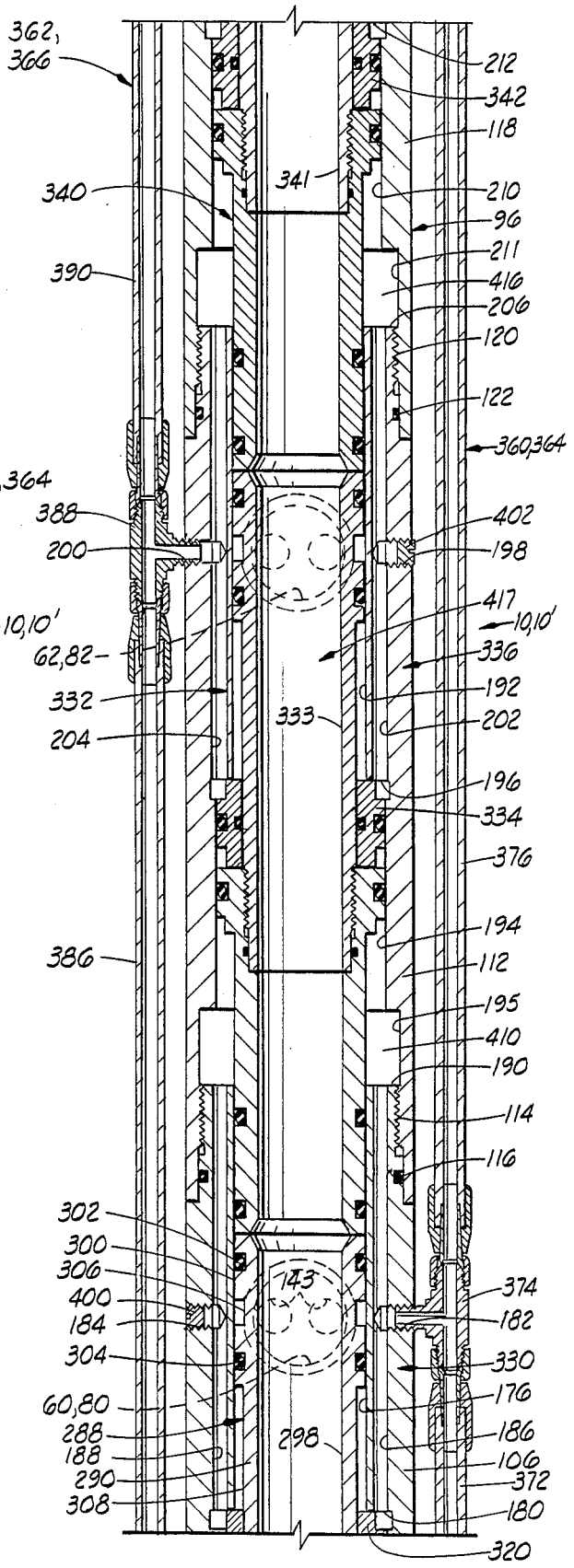
Figure 3C:
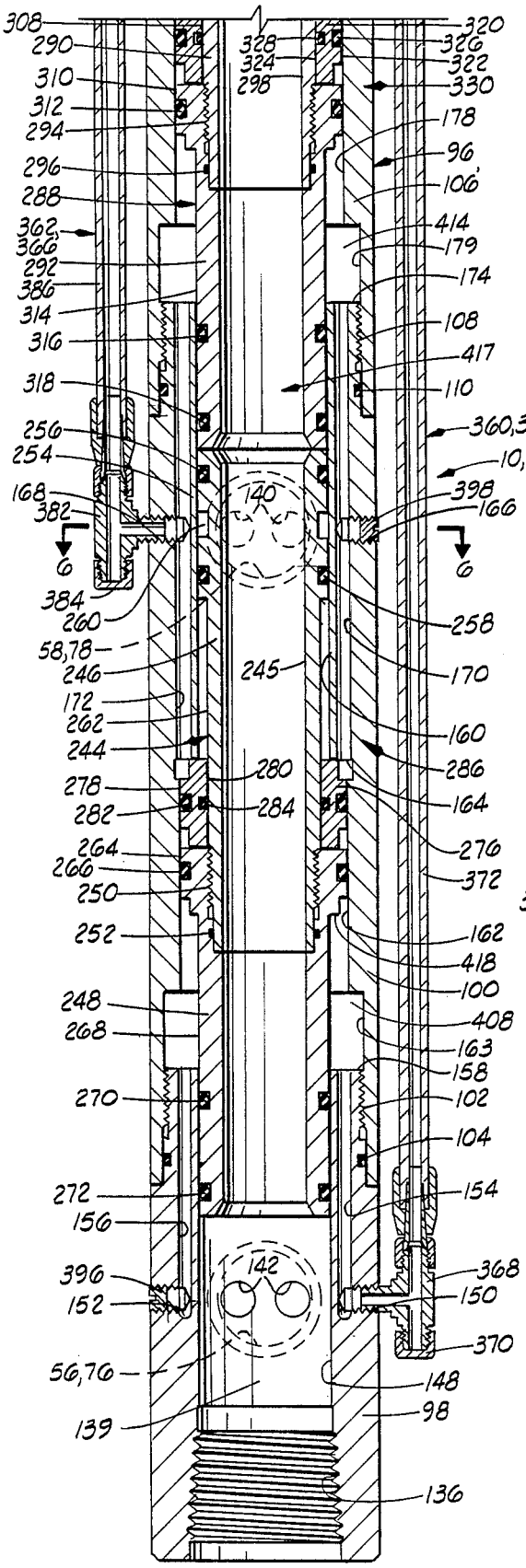

Referring now to FIGS. 3A–3C, details of grout control valve 10 and inflation control valve 10' will be discussed. Because grout control valve 10 and inflation control valve 10' are essentially identical, single reference numerals will be used in the discussion thereof, except as necessary to be consistent with FIGS. 1 and 2. As illustrated, control valves 10 and 10' comprise subassemblies or modules which are actuated from the bottom up, so the components thereof will be discussed generally in that order. However, it should be understood that control valves 10 and 10' may be positioned in virtually any direction, and they are not required to be in the vertical orientation shown.

Control valves 10 and 10' comprise elongated outer body means 96. Discharge ports 56, 58, 60, 62, 64 and 66 on grout control valve 10 and discharge ports 76, 78, 80, 82, 84 and 86 on inflation control valve 10' form an integral portion of body means 96. In the preferred embodiment, body means 96 includes several sections which will now be described in detail.

Referring to FIG. 3C, at the lower end of body means 96 is a first or lower adapter 98 which is connected to a first body 100 at a threaded connection 102 with seal means 104 providing sealing engagement therebetween. Typically, seal means 104 is in the form of an O-ring. The upper end of first body 100 is connected to the lower end of a second body 106 at threaded connection 108 with seal means 110 providing sealing engagement therebetween.

As shown in FIG. 3B, second body 106 is similarly connected to a third body 112 at threaded connection 114 with seal means 116 providing sealing engagement. Third body 114 is connected to fourth body 118 at threaded connection 120 with seal means 122.

As shown in FIG. 3A, fourth body 118 is in turn connected to fifth body 124 at threaded connection 126 with seal means 128 providing sealing engagement therebetween.

First body 100, second body 106, third body 112, fourth body 118 and fifth body 124 are substantially identical. As hereinafter described in more detail, the number of the substantially identical bodies may vary, and the invention is not intended to be limited to five such bodies.

The upper end of the final body, which in the illustrated embodiment is fifth body 124, is connected to a second or upper adapter 130 at threaded connection 132. Seal means 134 provides sealing engagement between fifth body 124 and upper adapter 130.

Lower adapter 98 defines a threaded opening 136 therein which is adapted to receive a pipe plug of a kind known in the art (not shown) which sealingly closes the lower end of lower adapter 98. Lower adapter 98 could also be made with a closed or blind end rather than using a pipe plug.

Upper adapter 130 preferably defines a threaded opening 138 in the upper end thereof which is adapted to receive main grout line 74 or main inflation line 94 of the permanent type or a connector for lines of the disconnectable type. Thus, threaded opening 138 forms the inlet to body means 96 and control valves 10 and 10' and is in communication with a central opening 139 therethrough. Rather than a threaded opening 138, upper adapter 130 could be welded to the line or connector.

Referring now to FIG. 6, a preferred construction of discharge ports 58 or 78 is shown. It should be understood that all of the discharge ports on body means 96 are substantially to the specific discharge ports 58 or 78 shown in FIG. 6. The portion of body means 96 from which discharge ports 58 or 78 extends, in this case first body 100, has a pair of parallel, transverse holes 140 extending therethrough. Discharge ports 56 and 76 have similar holes 142 therethrough, and discharge ports 60 and 80 have holes 143. Discharge ports 62, 64, 66, 82, 84 and 86 have similar transverse holes which are not numbered. Still referring to FIG. 6, a port tube 144 encloses the outer ends of transverse holes 140 and is attached to the exterior of first body 100 by a weld 146. Port tube 144 is connected to grout line 68 or inflation line 88 by any means, such as welding. However, port tube 144 could also be threaded for threading engagement with the appropriate grout or inflation lines, and the invention is not intended to be limited to this particular configuration.

It should be noted that the cross section shown in FIGS. 3A–3C, and also FIGS. 4A–4C and 5A–5C, is not a straight transverse cross section. Instead, the cross section in all of these figures is taken along lines 3—3 in FIG. 6.

Lower adapter 98 defines a central bore 148 therethrough in communication with discharge ports 56 or 76. Central bore 148, of course, forms a portion of central opening 139 of body means 96. Lower adapter 98 also includes a pair of threaded openings 150 and 152 therein which are in communication with a pair of longitudinal passageways 154 and 156, respectively. Longitudinal passageways 154 and 156 extend to upwardly facing shoulder 158 which forms the upper end of lower adapter 98.

First body 100 defines a first central bore 160 and a second central bore 162 therethrough with an annular recess or counterbore 163 therebelow. First central bore 160, second central bore 162, and annular recess 163 are all part of central opening 139 in body means 96. At the lower end of first central bore 160 is a downwardly facing shoulder 164. First body 100 also includes a pair of threaded openings 166 and 168 which intersect longitudinal passageways 170 and 172, respectively. Longitudinal passageways 170 and 172 extend downwardly to shoulder 164 and upwardly to upwardly facing shoulder 174 which forms the upper end of first body 100.

In an identical manner, second body 106 has a first central bore 176, a second central bore 178, a recess or counterbore 179, downwardly facing shoulder 180, threaded openings 182 and 184, longitudinal passageways 186 and 188 and an upwardly facing shoulder 190; third body 112 has a first central bore 192, second central bore 194, a recess or counterbore 195, a downwardly facing shoulder 196, threaded openings 198 and 200, longitudinal passageways 202 and 204, and an upwardly facing shoulder 206; fourth body 118 has a first central bore 208, a second central bore 210, a recess or counterbore 211, a downwardly facing shoulder 212, threaded openings 214 and 216, longitudinal passageways 218 and 220, and an upwardly facing shoulder 222; and fifth body 124 includes a first central bore 224, a second central bore 226, a recess or counterbore 227, a downwardly facing shoulder 228, threaded openings 230 and 232, longitudinal passageways 234 and 236, and an upwardly facing shoulder 238.

Upper adapter 130 defines a central bore 240 therethrough in communication with threaded opening 138. Central bore 240 forms a portion of central opening 139 through body means 96. A downwardly facing annular shoulder 242 is located at the lower end of central bore 240.

Each body has piston means therein such as first piston assembly 244 defining a central opening 245 therethrough which is slidably positioned in first body 100, as shown in FIG. 3C. Piston assembly 244 comprises an upper piston portion 246 connected to a lower piston portion 248 at threaded connection 250. Seal means 252 provides sealing engagement between upper piston portion 246 and lower piston portion 248. Upper piston portion 246 has a first outside diameter 254 in close, spaced relationship to first central bore 160 of first body 100. First or upper sealing means on piston assembly 244 such as a pair of piston rings 256 and 258 provides sealing engagement between upper piston portion 246 and bore 160. Upper piston portion 246 has an outwardly facing annular groove 260 therein between piston rings 256 and 258. Upper piston portion 246 also has a second outside diameter 262 spaced inwardly from first outside diameter 254.

Lower piston portion 248 has a first outside diameter 264 in close spaced relationship to second central bore 162 of first body 100. Second or intermediate sealing means on piston assembly 244 such as a piston ring 266 provides sealing engagement between lower piston portion 248 and bore 162. Lower piston portion 248 also has a second diameter 268 spaced inwardly from first outside diameter 264. Second outside diameter 268 extends into, and is in close, spaced relationship with, central bore 148 of lower adapter 98. Third or lower sealing means on piston assembly 244 such as a pair of piston rings 270 and 272 provides sealing engagement between lower piston portion 248 and bore 148.

Referring again to FIG. 6, first body 100 of body means 96 further defines a pair of threaded, transverse holes 274 which intersect first central bore 160 thereof. A shear pin 276 is disposed in each hole 274 and extends into groove 260 of upper piston portion 246 to initially lock first piston assembly 244 in the position shown in FIG. 3C.

A sleeve means is annularly positioned around each piston means such as first sleeve 27 annularly positioned around upper piston portion 246 of first piston assembly 244 and disposed above lower piston portion 248. Sleeve 276 has an outside diameter 278 in close spaced relationship to second central bore 162 of first body 100 and an inside diameter 280 in close spaced relationship to second outside diameter 262 of upper piston portion 246. Outer sealing means such as an outer sleeve ring 282 provides sealing engagement between first sleeve 276 and bore 162, and inner sealing means such as an inner sleeve ring 284 provides sealing engagement between the first sleeve and outside diameter 262 of upper piston portion 246. The inner and outer sealing means may also be referred to as a fourth sealing means.

First body 100, first piston assembly 244 and the piston rings associated therewith, first sleeve 276 and the sleeve rings associated therewith, and shear pins 775 may be said to form a first valve module 286.

Referring now also to FIG. 3B, a second piston assembly 288 is slidably disposed in second body 106. Second piston assembly 288 is substantially identical to first piston assembly 244 and includes an upper piston portion 290 and a lower piston portion 292 which are connected at threaded connection 294 with seal 296 providing sealing engagement therebetween. Second piston assembly 288 defines a central opening 298 longitudinally therethrough.

Upper piston portion 290 has a first outside diameter 300 in close spaced relationship to first central bore 176 of second body 106. First or upper sealing means such as a pair of piston rings 302 and 304 provides sealing engagement between upper piston portion 290 and bore 176. Upper piston portion 290 includes an outwardly facing annular groove 306 between piston rings 302 and 304. Shear pins (not shown) identical to shear pins 275 extend into annular groove 306 to hold second piston assembly 288 in the initial position shown in FIGS. 3B and 3C. Upper piston portion 290 also has a second outside diameter 308 spaced inwardly from first outside diameter 300.

Second piston portion 292 has a first outside diameter 310 in close spaced relationship to second central bore 178 of second body 106. Second or intermediate sealing means such as a piston ring 312 provides sealing engagement between lower piston portion 292 and bore 178. Lower piston portion 292 has a second outside diameter 314 which extends into, and is in close, spaced relationship with, first central bore 160 of first body 100. Third or lower sealing means such as a pair of piston rings 316 and 318 provides sealing engagement between lower piston portion 292 and bore 160. As seen in FIG. 3C, the lower end of second piston assembly 288 is adjacent the upper end of first piston assembly 244.

Annularly positioned around upper piston 290 and above lower piston portion 292 is a second sleeve 320 which has an outside diameter 322 in close spaced relationship to second bore 178 of second body 106 and an inside diameter 324 in close, spaced relationship to second outside diameter 308 of upper piston portion 290. Outer sealing means such as an outer sleeve ring 326 provides sealing engagement between second sleeve 320 and bore 178, and inner sealing means such as an inner sleeve ring 328 provides sealing engagement between the second sleeve and outside diameter 308.

It will thus be seen that second body 106, second piston assembly 288 and the piston rings associated therewith, second sleeve 320 and the sleeve rings associated therewith, and the shear pins (not shown) locating the second piston assembly may be said to form a second valve module 330 which is substantially identical to first valve module 286.

A third piston assembly 332 defining a central opening 333 therethrough and a third sleeve 334 annularly positioned around the upper portion of the third piston assembly are slidably disposed in third body 112 in a manner identical to first and second piston assemblies 244 and 288 and first and second sleeves 276 and 320. Because of the identical construction, the details of third piston assembly 332 and third sleeve 334 and the piston rings and sleeve rings associated therewith are left unnumbered. It will be seen that the lower end of third piston assembly 332 is adjacent the upper end of second piston assembly 288. Third body 112, third piston assembly 332, third sleeve 334 and the associated pistons and sleeve rings and shear pins form a third valve module 336.

Similarly, a fourth valve module 338 includes fourth body 118, fourth piston assembly 340 defining a central opening 341 therethrough, fourth sleeve 342, and the associated piston rings, sleeve rings and shear pins. A fifth valve module 344 includes fifth body 124, fifth piston assembly 346 defining a central opening 347 therethrough, fifth sleeve 348, and the associated piston rings, sleeve rings and shear pins.

As seen in FIG. 3A, a spacer 350 having a central opening 352 therethrough is disposed between fifth body 124 and upper adapter 130. Spacer 350 has a radially outwardly extending annular portion 354 thereon which is adapted for positioning in the gap between shoulder 242 on upper adapter 130 and upper surface 238 on fifth body 124. A seal 356 provides sealing engagement between spacer 350 and central bore 240 of upper adapter 130, and another seal 358 provides sealing engagement between the spacer and first central bore 224 of fifth body 124. It will be seen that spacer 350 and seals 356 and 358 sealingly close the upper end of longitudinal passageways 234 and 236 in fifth body 124. Referring now to FIGS. 1 and 3A–3C, a first actuation line 360 and a second actuation line 362 are connected to grout control valve 10. Pressure transmitted through first and second actuation lines 360 and 362 are used to operate grout control valve 10 in a manner hereinafter described. Similarly, first and second actuation lines 364 and 366 are connected to inflation control valve 10'. Each actuation line comprises several tube fittings and tube sections. First actuation lines 360 or 364 have a tube fitting 368 at the lower end thereof which is connected to threaded opening 150 in lower adapter 98. A cap 370 closes the lower end of tube fitting 368. Extending upwardly from tube fitting 368 is a tube 372. Tube 372 is connected to another tube fitting 374 which is engaged with threaded opening 182 in second body 106. Extending upwardly from tube fitting 374 is a tube 376 which is connected to still another tube fitting 378. Tube fitting 378 is engaged with threaded opening 214 in fourth body 118. Another tube 380 extends upwardly from tube fitting 378 and beyond control valve 10 or 10' to the surface where it is connected to a first pressure source of a kind known in the art (not shown).

Second actuation lines 362 and 366 have a tube fitting 382 at the lower end thereof which is engaged with threaded opening 168 in first body 100. A cap 384 closes the lower end of tube fitting 382. A tube 386 extends upwardly to another tube fitting 388 which is engaged with threaded opening 200 in third body 112. Another tube 390 extends upwardly from tube fitting 388 to still another tube fitting 392 which is engaged with threaded opening 232 in fifth body 124. A tube 394 extends upwardly from tube fitting 392 and above control valve 10 or 10' to the surface where it is connected to a second pressure source of a kind known in the art (not shown).

Threaded openings 152 in lower adapter 98, 166 in first body 100, 184 in second body 106, 198 in third body 112, 216 in fourth body 118, and 230 in fifth body 124 are sealingly closed by plugs 396, 398, 400, 402, 404, and 406, respectively.

It will thus be seen that first actuation lines 360 and 364 are in communication with annular volume 408 adjacent first piston assembly 244 through longitudinal passageway 154, second sleeve 320 and annular volume 410 adjacent third piston assembly 332 through longitudinal passageway 186, and fourth sleeve 342 and annular volume 412 adjacent fifth piston assembly 346 through longitudinal passageway 218.

Similarly, second actuation lines 362 and 366 are in communication with first sleeve 276 and annular volume 414 adjacent second piston assembly 288 through longitudinal passageway 172, third sleeve 334 and annular volume 416 adjacent fourth piston assembly 340 through longitudinal passageway 204, and fifth sleeve 348 through longitudinal passageway 236.

Thus, first pressure passageway means are provided in communication with each piston means on a side of the second sealing means, and second pressure passageway means are provided in communication with the piston means on an opposite side of the second sealing means.

OPERATION OF THE INVENTION

When the offshore platform leg assembly or the tension leg platform template are set on the sea floor, the internal components of grout control valve 10 and inflation control valve 10' are in the position shown in FIGS. 3A–3C. During the process of setting the leg assembly or template, and at all times prior to actuation of control valves 10 or 10', first actuation lines 360 and 364 are maintained at a pressure as high or higher than second actuation lines 362 and 366.

It will be seen by those skilled in the art that annular volume 408 along with longitudinal passageways 154 and 156, annular volume 410 along with longitudinal passageway 186 and 188, and annular volume 412 along with longitudinal passageways 218 and 220 are maintained at a substantially constant pressure which is as high or higher than the pressure in annular volume 414 along with longitudinal passageways 170 and 172, annular volume 416 along with longitudinal passageways 202 and 204, and longitudinal passageways 234 and 236.

Obviously, if the pressures are equal, none of the piston assemblies will move. However, it will be seen that the piston assemblies also will not move if the pressure in first actuation lines 360 and 364 is greater than that in second actuation lines 362 and 366. This pressure differential exerts an upward force on first piston assembly 244, but upward movement of the first piston assembly is prevented by the contact of first sleeve 276 with shoulder 164 in first body 100. A substantially equal downward force is exerted on second piston assembly 288, but this is counteracted by the upward force exerted on first piston assembly 244. Similarly, an upward force is applied to third piston assembly 332 such that third sleeve 334 bears against shoulder 196 in third body 112, and this counteracts a substantially equal downward force exerted on fourth piston 340. The same upward force is applied to fifth piston assembly 346 such that fifth sleeve 348 bears against shoulder 228 in fifth body 124.

It will be seen that central openings 245, 298, 333, 341 and 347 through first piston assembly 244, second piston assembly 288, third piston assembly 332, fourth piston assembly 340, and fifth piston assembly 346, respectively, along with central opening 352 in spacer 350 and portions of central opening 139 in body means 96 form a generally longitudinal central passageway 417 through control valves 10 and 10'. In the initial position of FIGS. 3A–3C, only the lowermost discharge ports 56 and 76 of control valves 10 and 10', respectively, are in communication with central passageway 417. In this position, inflatable packer 24 may be inflated. Thus, if inflation pressure is transmitted through main inflation line 94 to inflation control valve 10', inflation pressure is thus transmitted to inflatable packer 24 through discharge port 76, inflation line 88 and inflation check valve 44. In other words, inflation pressure is only applied to inflatable packer 24.

It will be seen that all of piston assemblies 244, 288, 332, 340 and 346 are always balanced with respect to pressure in central passageway 417 and any of discharge ports 76, 78, 80, 82, 84 and 86. Thus, pressure changes in central passageway 417 and the discharge ports will not act to move the piston assemblies. Further, actuation of the piston assemblies will have no effect on the pressure in central passageway 417 or in the discharge ports except to provide communication between the central passageway and the discharge ports as described herein.

Figure 4A:
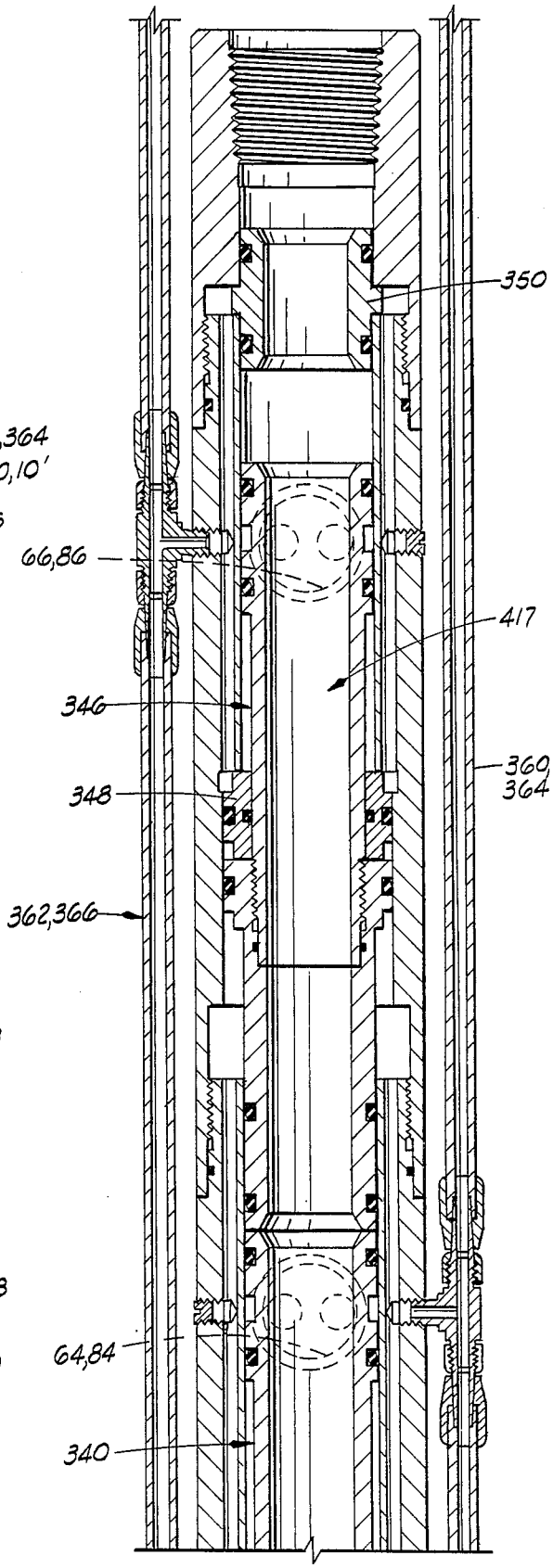
FIGS. 4A–4C illustrate the pressure actuated control valve with a first piston and sleeve therein actuated.
Figure 4B:
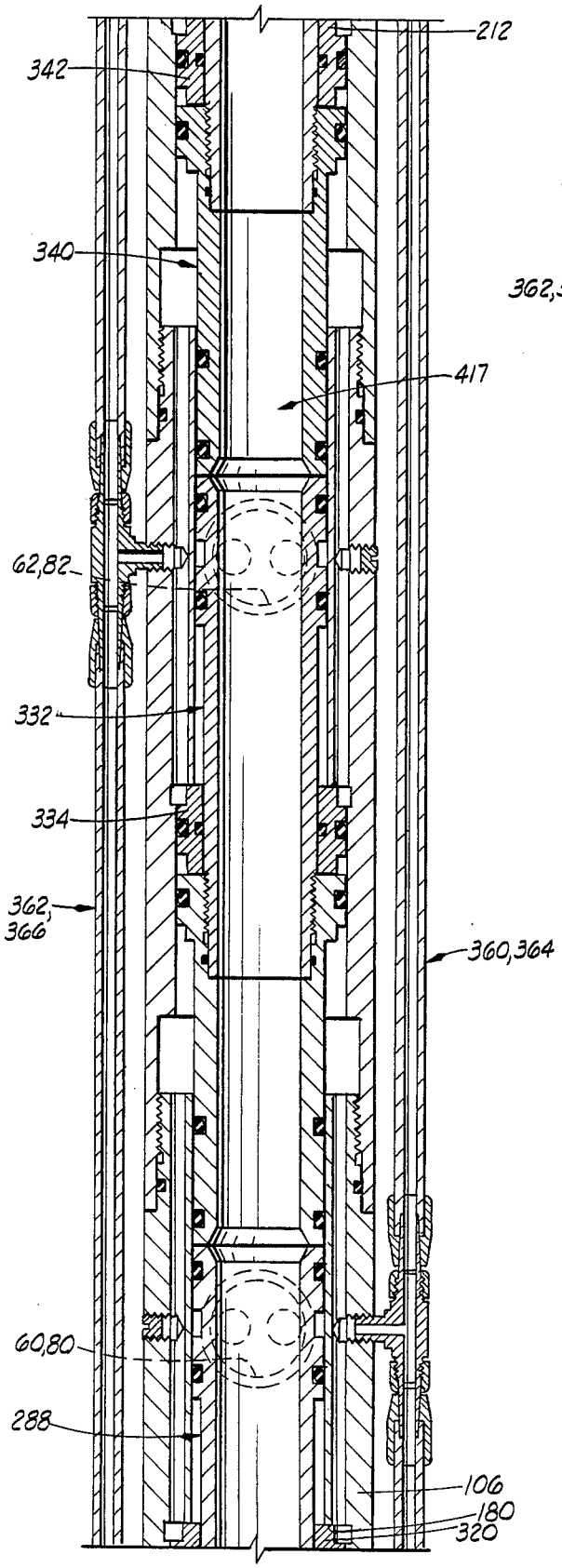
Figure 4C:
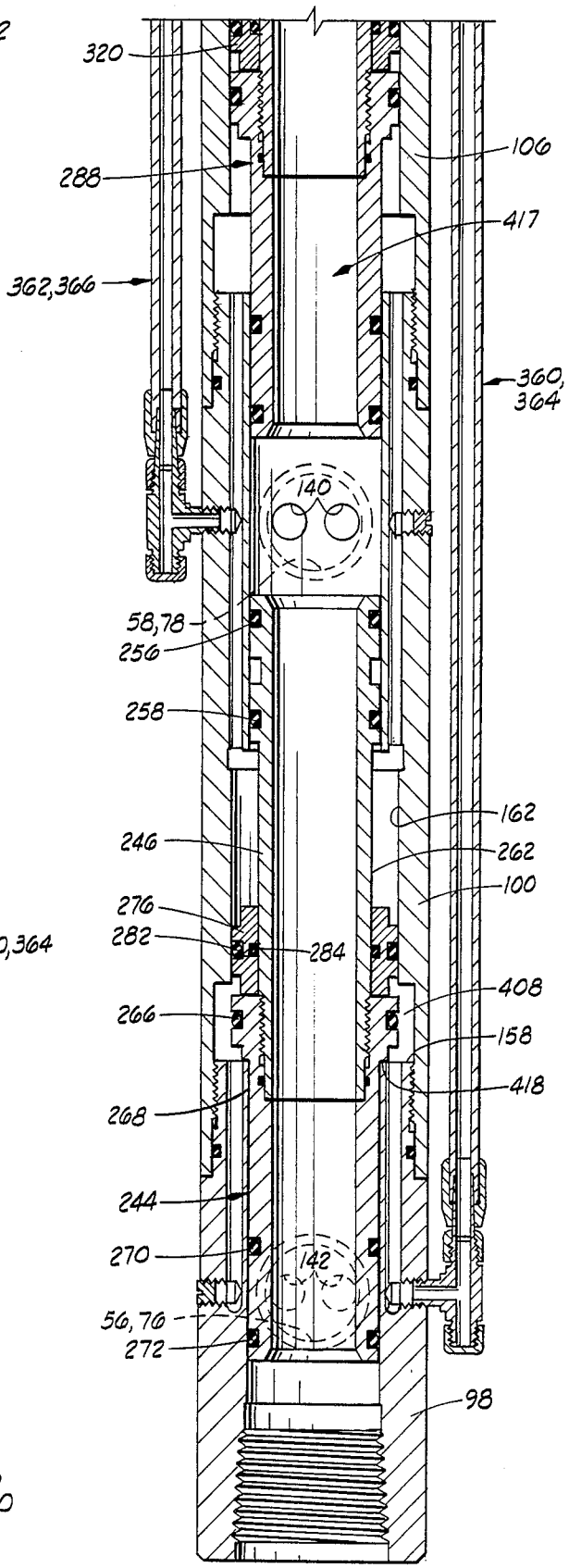

After inflatable packer 24 has been fully inflated, the next inflatable packer 26 may be inflated by actuating inflation control valve 10'. Referring to FIGS. 4A–4C, to actuate control valve 10', pressure is relieved in first actuation line 364, and the pressure in second actuation line 366 is raised to a higher level than that in the first actuation line. When this occurs, the pressure in annular volume 414 along with longitudinal passageways 170 and 172, annular volume 416 along with longitudinal passageways 202 and 204, and longitudinal passageways 234 and 236 is higher than the pressure in annular volume 408 along with longitudinal passageways 154 and 156, annular volume 410 along with longitudinal passageways 186 and 188, and annular volume 412 along with longitudinal passageways 218 and 220. Thus, the forces acting on the various piston assemblies are reversed. A downward force is applied to first sleeve 276 and thus to first piston assembly 244 sufficient to shear pins 275 and to move first sleeve 276 and first piston assembly 244 downwardly to the position shown in FIG. 4C. The downward movement of first piston assembly 244 is limited by the contact of shoulder 418 thereon with upper surface 158 of lower adapter 98.

When first piston assembly 244 is in its lowermost position, it will be noted that piston ring 266 is no longer in sealing engagement with second central bore 162 of first body 100. Instead, piston ring 266 is simply exposed in annular volume 408 and does not function further. First piston assembly 244 is still moved to its lowermost position because outer sleeve ring 282 is still in sealing engagement with second central bore 162 of first body 100, and inner sleeve ring 284 is maintained in sealing engagement with second outside diameter 262 of upper piston portion 246. Also, when first piston assembly 244 is in the lowermost position, discharge port 76 is closed with respect to central passageway 417 because transverse holes 142 are sealed between piston rings 270 and 272.

In addition to the effect on first piston assembly 244, when second actuation line 366 is at a higher pressure than first actuation line 364, an upward force is applied to second piston assembly 288 such that second sleeve 320 bears against shoulder 180 in second body 106 as seen in FIG. 4B. A downward force is applied to third piston assembly 332 which is counteracted by the upward force on second piston assembly 288. Similarly, as seen in FIGS. 4B and 4C, an upward force is applied to fourth piston assembly 340 such that fourth sleeve 342 bears against shoulder 212, and a downward force is applied to fifth piston assembly 346 which is counteracted by the upward force on the fourth piston assembly.

Referring now to FIGS. 1 and 4C, when first piston assembly 244 is moved downwardly, piston rings 256 and 258 move away from holes 140 so that discharge port 78 is in communication with central passageway 417 through control valve 10'. Thus, inflation pressure through control valve 10' is transmitted through discharge port 78, inflation line 90 and check valve 46 to inflate inflatable packer 26.

Figure 5A:
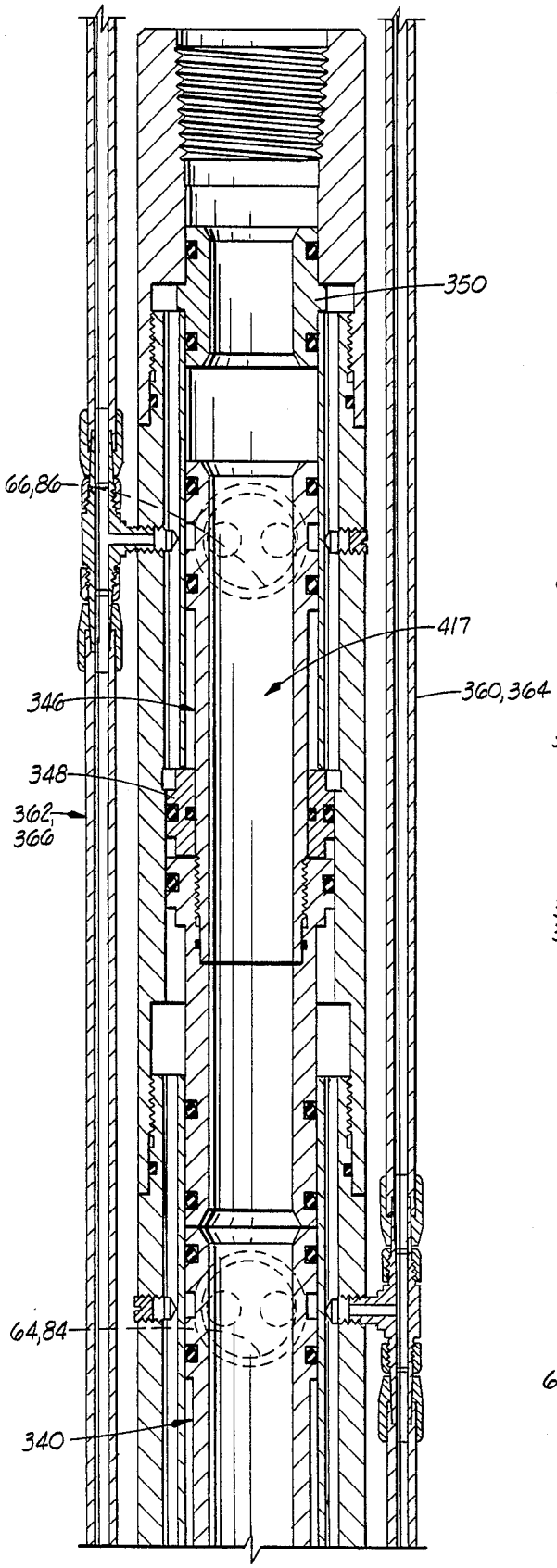
FIGS. 5A–5C show the pressure actuated control valve after a second piston and sleeve therein are actuated.
Figure 5B:
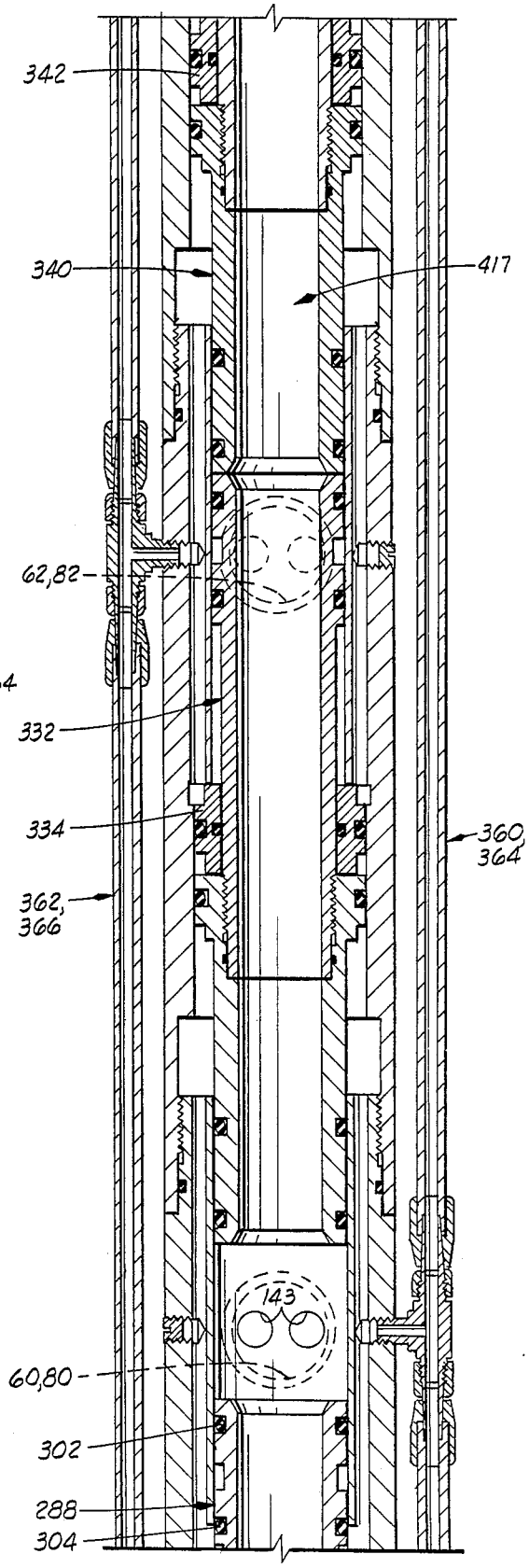
Figure 5C:
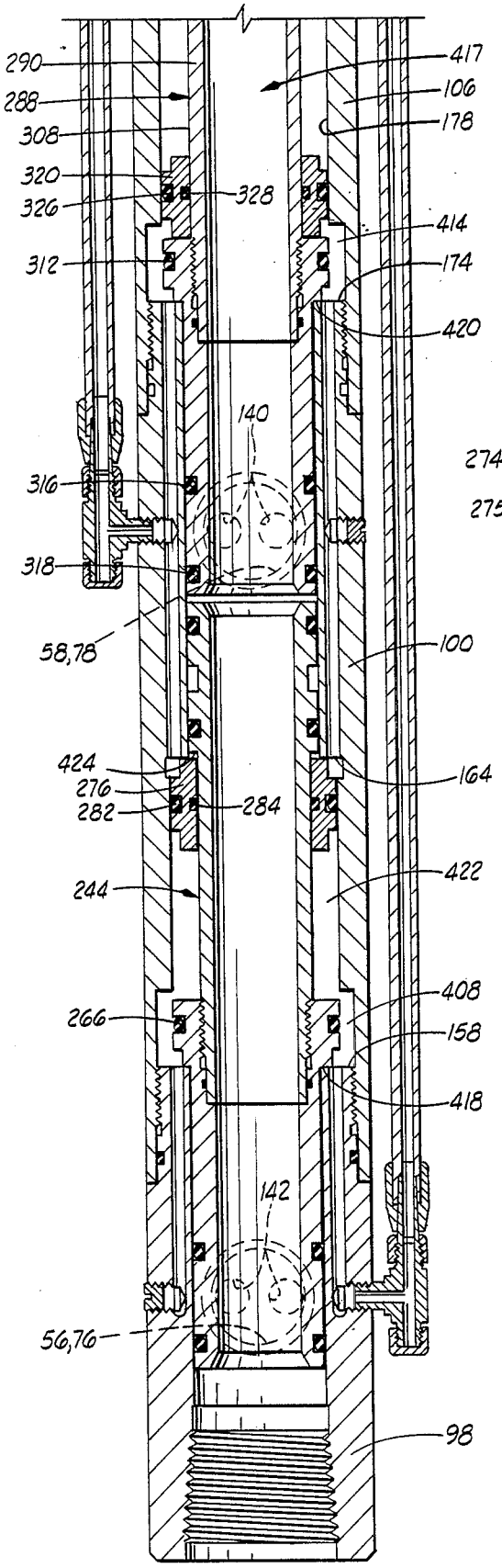
Figure 5:
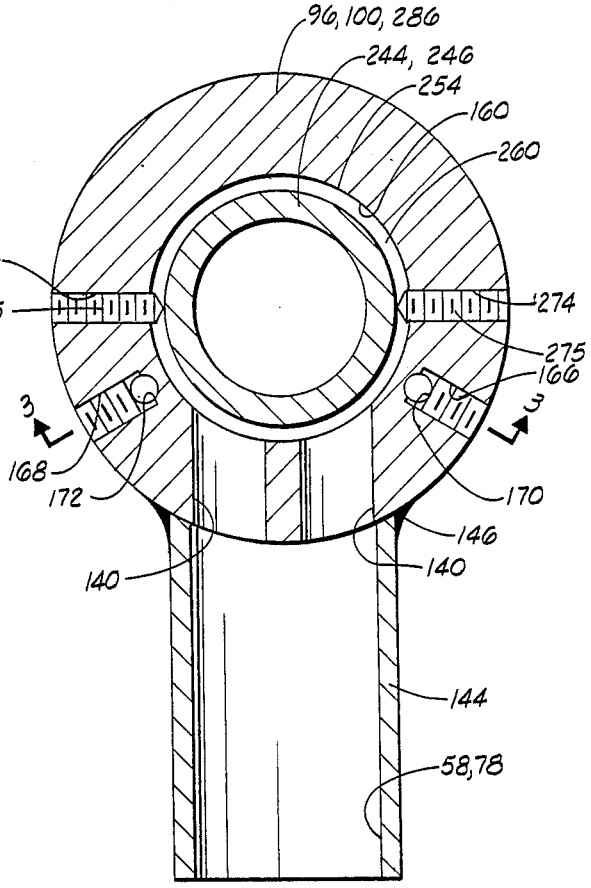

Once inflatable packer 26 is fully inflated, the pressures in first and second actuation lines 364 and 366 are again reversed so that the pressure in the first actuation line is higher. Referring now to FIGS. 5A–5C, it will be seen that second sleeve 320 and thus second piston assembly 288 is moved downwardly after the shear pins (not shown) holding it in place are sheared because first piston assembly 244 is no longer there to stop such movement. Of course, third piston assembly 332, fourth piston assembly 340, and fifth piston assembly 346 remain static.

When second piston assembly 288 is moved downwardly, shoulder 420 thereon contacts upwardly facing shoulder 174 of first body 100 which acts to limit downward movement of the second piston assembly. In this position, piston rings 316 and 318 sealingly close transverse holes 140 in discharge port 78 from central passageway 417. Simultaneously, as seen in FIG. 5B, piston rings 302 and 304 are moved away from transverse holes 143 in discharge port 80 so that discharge port 80 is in communication with central passageway 417. Thus, inflation pressure in control valve 10' is transmitted through discharge port 80, discharge line 92, and check valve 48 to inflate inflatable packer 28.

When second piston assembly 288 is moved to the lowermost position shown in FIGS. 5B and 5C, piston ring 312 thereon is no longer in sealing engagement with second central bore 178 in second body 106. Instead, piston ring 312 is exposed and nonfunctional in annular volume 414. Second piston assembly 288 is moved to this lowermost position because outer sleeve ring 326 on second sleeve 320 is still in sealing engagement with second central bore 178 of second body 106, and inner sleeve ring 328 is maintained in sealing engagement with second outside diameter 308 of upper piston portion 290 of second piston assembly 288.

Because piston ring 266 on first piston assembly 244 is no longer functional, the increased pressure in annular volume 408 acts across the annular differential area between second outside diameter 268 of lower piston portion 248 and second outside diameter 262 of upper piston portion 246, thus providing a downward force on the first piston assembly. The pressure in annular volume 408 also acts upwardly on first sleeve 276 such that the first sleeve is moved upwardly to again contact downwardly facing shoulder 164 of first body 100. Thus, a new annular volume 422 is defined below first sleeve 276, and this new annular volume is in communication with annular volume 408. First piston assembly 244 is sized such that downwardly facing shoulder 418 thereon engages upwardly facing shoulder 158 of lower adapter 98. Another downwardly facing shoulder 424 thereon cannot engage first sleeve 276, even though first sleeve 276 is in its uppermost, initial position.

In an identical manner, third piston assembly 332 may be actuated downwardly to close discharge port 80 and open discharge port 82, fourth piston assembly 340 may be moved downwardly to close discharge port 82 and open discharge port 84, and fifth piston assembly 346 may be moved downwardly to close discharge port 84 and open discharge port 86. Second sleeve 320, third sleeve 334, fourth sleeve 342, and fifth sleeve 348 are correspondingly actuated.

Thus, all of the discharge ports in control valve 10' may be sequentially opened with respect to central passageway 417 to allow inflation pressure to be directed therethrough to sequentially inflate a series of inflation packers. While six such discharge ports 76, 78, 80, 82, 84, and 86 are shown on inflation control valve 10', it will be readily understood that a greater or lesser number of discharge ports may be provided by increasing or decreasing the number of valve modules. In other words, the number of inflatable packers actuatable by an inflation control valve 10' is not limited to any particular number as is required in the prior art.

Grout control valve 10 is sequentially actuated in an identical manner to that described above for inflation control valve 10' to sequentially grout the annular volumes above the inflatable packers, such as annular volumes 38, 40 and 42. It also should be understood that while the procedure has been described as first inflating all of the inflatable packers prior to grouting, each inflatable packer may be inflated and the corresponding annular volume thereabove grouted immediately thereafter prior to inflating the next packer. It is not necessary to inflate all of the packers prior to grouting.

In an alternate embodiment, shown in phantom lines, in FIG. 1, grout control valve 10 and inflatable control valve 10' may be combined to form a single control valve 10'', with main grout line 74 and main inflation line 94 combined into a single line 94' to the surface. Inflation pressure may be applied to this single line and the appropriate piston assemblies actuated to sequentially inflate all of the inflatable packers. After this is carried out, grout may then be pumped down the single line to grout the corresponding annular volumes above the inflatable packers. Thus, an extremely flexible system is provided. Actuation lines 360 and 364 may be combined into a single actuation line 364', and similarly, actuation lines 362 and 366 may be combined into a single actuation line 366'.

In another alternate embodiment, first actuating lines 360 and 364 may be omitted with threaded openings 150, 182 and 214 left open. Thus, when leg assembly 12 is located at the sea floor, the ocean hydrostatic pressure is transmitted through the threaded openings. Second actuating lines 362 or 366 must be connected to a gaseous pressure source and pressurizing these lines above the hydrostatic pressure will actuate first piston assembly 244 in the same manner as already described. A gas rather than a liquid must be used in this embodiment, so that a hydrostatic pressure due to a column of liquid in actuating lines 352 or 366 is avoided. Relieving pressure on second actuating lines 362 and 366 below hydrostatic pressure will then cause second piston assembly 288 to be actuated, and this sequence can be carried out until all the piston assemblies have been actuated. Of course, the shear pins holding second piston assembly 288 and fourth piston assembly 340 must be sized such that the ocean hydrostatic pressure will shear them when the pressure is applied to the corresponding sleeves and piston assemblies.

It should also be understood by those skilled in the art that, while the pressure actuated control valve of the present invention has been described as a grout control valve 10 or an inflation control valve 10', the pressure actuated valve may be used in any situation where it is desired to sequentially direct fluids to a series of locations. The invention is not necessarily limited to an undersea inflation or grouting application, but is obviously well designed for such purpose.

It will be seen, therefore, that the pressure actuated flow control valve of the present invention is well adapted to carry out the ends and advantages mentioned, as well as those inherent therein. While a presently preferred embodiment of the apparatus has been shown for the purposes of this disclosure, numerous changes in the arrangement and construction of parts and the method of operation may be made by those skilled in the art. In particular, it should be understood that a variety of actuation sequences may be used other than those specifically described herein. All such changes in the arrangement and construction of parts and in the operation of the apparatus are encompassed within the scope and spirit of the appended claims.

What is claimed is:

1. A valve module apparatus comprising:

body means defining a central opening therethrough and having port means in communication with said central opening, said body means being adapted for connection to similar body means of an adjacent valve module;

piston means slidably disposed in said central opening of said body means and having first and second sealing means thereon, said piston means having a first position wherein said first sealing means sealingly closes said port means and a second position opening said port means;

first pressure passageway means in communication with said piston means on a side of said second sealing means, whereby a force is applied on said piston means for holding said piston means in said first position;

second pressure passageway means in communication with said piston means on an opposite side of said second sealing means, whereby a force is applied on said piston means for moving said piston means from said first position to said second position; and means for preventing movement of said piston means from said second position to said first position.

2. The apparatus of claim 1 further comprising shear means for holding said piston means in said first position.

3. The apparatus of claim 1 wherein:

said piston means further has third sealing means thereon; and said valve module is one of a plurality of valve modules oriented such that said third sealing means sealingly closes port means of an adjacent valve module as said piston means is moved from said first position to said second position.

4. The apparatus of claim 3 wherein said first and third sealing means are substantially the same diameter.

5. The apparatus of claim 4 wherein said first and third sealing means are smaller than said second sealing means.

6. The apparatus of claim 1 wherein:

said means for preventing movement of said piston means from said second position to said first position comprises sleeve means annularly disposed around said piston means and having inner and outer sealing means thereon for sealingly engaging said piston means and said body means, respectively, said sleeve means having a first position and a second position;

said second pressure passageway means is in communication with said sleeve means between said inner and outer sealing means and said first sealing means such that said force for moving said piston means from said first to said second position is applied through said sleeve means on said piston means, whereby said piston means is moved from said first position to said second position thereof as said sleeve means is moved from said first position to said second position thereof; and when said piston means is in said second position, said second sealing means is disengaged from said body means such that pressure from said first pressure passageway means is balanced on said piston means.

7. The apparatus of claim 6 wherein after said second sealing means is disengaged, said pressure from said first pressure passageway means applies a force on said sleeve means for moving said sleeve means from said second to said first position thereof, said piston means remaining in said second position thereof.

8. The apparatus of claim 6 wherein:

said piston means defines shoulder means thereon; and said sleeve means bears against said shoulder means for moving said piston means from said first to said second position.

9. A pressure actuated flow control valve comprising:

an elongated body defining a central opening therethrough, a plurality of discharge ports in communication with said central opening;

a plurality of pistons slidably disposed in said central opening of said body between first and second positions, each piston being positioned adjacent a corresponding discharge port;

first sealing means on an end of each of said pistons for sealingly closing said corresponding discharge port when said piston is in said first position;

second sealing means on an intermediate portion of each of said pistons for sealing engagement with said body when said piston is in said first position, said second sealing means being disengaged from said body when said piston is in said second position;

third sealing means at an opposite end of each of said pistons for sealingly closing another discharge port adjacent said corresponding discharge port when said piston is in said second position;

a plurality of sleeves, each of said sleeves being slidably disposed around a corresponding one of said pistons between said first and second sealing means thereon and movable between first and second positions;

fourth sealing means on each of said sleeves for providing sealing engagement between each sleeve and said body and between each sleeve and the corresponding piston;

a pressure line in communication with a volume adjacent said opposite end of every other piston and a volume adjacent said first-mentioned end of the remaining pistons; and a second pressure line in communication with a volume adjacent said first-mentioned end of every other piston and a volume adjacent said opposite end of said remaining pistons;

wherein, alternate pressurizing of said first and second pressure lines results in sequential movement of said pistons from said first to said second positions.

10. The control valve of claim 9 further comprising a shear pin holding each of said pistons in said first position.

11. The control valve of claim 9 wherein said body comprises:

a plurality of substantially identical body portions, each of said body portions having one of said discharge ports thereon and corresponding to one of said pistons;

a first adapter having one of said discharge ports thereon and closing one end of said central opening; and a second adapted defining an inlet to said central opening.

12. The control valve of claim 11 wherein:

each body portion comprises:

a first bore adapted for sealingly receiving said first sealing means of said corresponding piston and further adapted for receiving said third sealing means of a piston adjacent said corresponding piston;

a second bore for sealingly receiving said second sealing means when said corresponding piston is in said first position and for sealingly receiving said fourth sealing means; and a recess for non-sealingly receiving said second sealing means when said corresponding piston is in said second position; and said first adapter comprises a bore for receiving said third sealing means of an adjacent piston.

13. The control valve of claim 12 wherein:

a differential pressure across a piston and corresponding sleeve exerts a force for moving the piston and corresponding sleeve from said first positions to said second positions thereof; and an opposite differential pressure across the piston and corresponding sleeve exerts a force for moving said corresponding sleeve from said second position to said first position thereof with said piston remaining in said second position thereof.

14. The control valve of claim 13 wherein each piston has a shoulder thereon which is engaged by the corresponding sleeve when said differential pressure acts thereacross.

15. The control valve of claim 12 wherein:

each body portion defines a pressure port therein adapted for receiving a portion of one of said first and second pressure lines and further defines a longitudinal passageway in communication with said pressure port and extending between said recess in said body portion and an opposite end of said body portion; and said first adapter defines a pressure port therein adapted for receiving a portion of one of said first and second pressure lines and further defines a longitudinal passageway in communication with said pressure port in said first adapter and extending between an end of said first adapter and said pressure port therein.

16. The control valve of claim 9 wherein each of said first and third sealing means comprises a pair of piston rings adapted for sealing on opposite sides of a discharge port.

17. The control valve of claim 9 wherein each of said discharge ports has a pair of transverse holes equally longitudinally positioned on said body.

18. The control valve of claim 9 wherein said first and second sealing means are substantially the same diameter.

19. The control valve of claim 18 wherein said second sealing means is larger than said first and third sealing means.

20. An inflation system for inflating a plurality of inflatable packers on an offshore platform, said system comprising:

a pressure actuated valve having a plurality of discharge ports thereon and comprising means for sequentially placing said discharge ports in communication with an inflation source;

a plurality of inflation lines providing communication between corresponding packers and discharge ports; and a pressure line separate from said inflation lines providing communication between said means and a pressure source separate from said inflation source.

21. The system of claim 20 wherein each of said inflation lines comprises check valve means for preventing deflation of said packers.

22. The system of claim 20 wherein:

said valve defines a central passageway therethrough in communication with said inflation source; and said means comprises:

a plurality of piston assemblies in said central passageway, each piston assembly being movable from a position closing a discharge port to another position opening said discharge port in response to a pressure differential across said piston assembly; and said pressure line provides communication between said piston assemblies and said pressure source.

23. The system of claim 22 wherein said valve further comprises means for preventing reverse movement of said piston assemblies.

24. A grout system for grouting a plurality of annuli defined between jackets and corresponding piles of an offshore platform leg assembly, said system comprising:

a pressure actuated valve having a plurality of discharge ports thereon and comprising means for sequentially placing said discharge ports in communication with a grout source;

a plurality of grout lines providing communication between corresponding annuli and said discharge ports; and a pressure line separate from said grout lines for providing communication between said means and a pressure source separate from said grout source.

25. The system of claim 24 wherein each of said grout lines comprises check valve means for preventing reverse flow of grout therethrough.

26. The system of claim 25 wherein:

said valve defines a central passageway therethrough in communication with said grout source; and said means comprises:

a plurality of piston assemblies in said central passageway, each piston assembly being movable from a position closing a discharge port to another position opening said discharge port in response to a pressure differential across said piston assembly; and said pressure line provides communication between said piston assemblies and said pressure source.

27. The system of claim 26 wherein said valve further comprises means for preventing reverse movement of said piston assemblies.

28. An offshore platform with an above surface platform portion and comprising:

a plurality of jacket legs extending downwardly from said platform portion to a sea floor;

a leg pile disposed within each of said jacket legs such that a leg annulus is defined therebetween, said leg pile being driven into said sea floor;

a plurality of skirt sleeves attached to each of said jacket legs and positioned on said sea floor;

a sleeve pile disposed within each of said skirt sleeves such that a sleeve annulus is defined therebetween, said sleeve pile being driven into said sea floor;

an inflatable packer disposed at a lower end of each leg annulus and sleeve annulus;

an inflation source;

pressure actuated inflation valve means having a plurality of inflation discharge ports thereon and comprising inflation means for sequentially placing said inflation discharge ports in communication with said inflation source;

a plurality of inflation lines providing communication between corresponding packers and said inflation discharge ports an inflation pressure line providing communication between said inflation means and a pressure source separate from said inflation source;

a grout source;

pressure actuated grout valve means having a plurality of grout discharge ports thereon and comprising grout means for sequentially placing said grout discharge ports in communication with said grout source;

a plurality of grout lines providing communication between corresponding annuli and said grout discharge ports; and a grout pressure line providing communication between said grout means and a pressure source separate from said grout source.

29. The platform of claim 28 wherein:

each of said inflation lines comprises an inflation check valve therein for preventing deflation of said packers; and each of said grout lines comprises a grout check valve therein for preventing reverse flow of grout therethrough.

30. The platform of claim 28 wherein said inflation source is positioned on said platform portion and further comprising a main inflation line providing communication between said inflation source and said inflation valve means.

31. The platform of claim 28 wherein said grout source is positioned on said platform portion and further comprising a main grout line providing communication between said grout source and said grout valve means.

32. The platform of claim 28 wherein:

said inflation valve means defines an inflation passageway therethrough;

said grout valve means defines a grout passageway therethrough;

said inflation means comprises:

a plurality of inflation pistons in said inflation passageway and movable from a first position closing an inflation discharge port to a second position opening said inflation discharge port in response to a differential pressure across said inflation piston; and said inflation pressure line provides communication between said inflation pistons and the pressure source; and said grout means comprises:

a plurality of grout pistons in said grout passageway and movable from a first position closing a grout discharge port to a second position opening said grout discharge port in response to a pressure differential across said grout piston; and said grout pressure line provides communication between said grout pistons and the pressure source.

33. The platform of claim 32 wherein at least one of said pressure sources is on said platform portion.

34. The platform of claim 32 wherein:

said inflation valve means further comprises means for preventing reverse movement of said inflation pistons; and said grout valve means further comprises means for preventing reverse movement of said grout pistons.

35. A template for an offshore tension leg platform, said template comprising:

a plurality of skirt sleeves positioned on a sea floor;

a sleeve pile disposed within each of said skirt sleeves such that a sleeve annulus is defined therebetween, said sleeve pile being driven into said sea floor;

an inflatable packer disposed at a lower end of each sleeve annulus;

an inflation source;

pressure actuated inflation valve means having a plurality of inflation discharge ports thereon and comprising inflation means for sequentially placing said inflation discharge ports in communication with said inflation source;

a plurality of inflation lines providing communication between corresponding packers and said inflation discharge ports;

an inflation pressure line providing communication between said inflation means and a pressure source separate from said inflation source;

a grout source;

pressure actuated grout valve means having a plurality of grout discharge ports thereon and comprising grout means for sequentially placing said grout discharge ports in communication with said grout source;

a plurality of grout lines providing communication between corresponding annuli and said grout discharge ports; and a grout pressure line providing communication between said grout means and a pressure source separate from said grout source.

36. The template of claim 35 wherein:

each of said inflation lines comprises an inflation check valve therein for preventing inflation of said packers; and each of said grout lines comprises a check valve therein for preventing reverse flow of grout therethrough.

37. The template of claim 35 wherein said inflation source is positioned on an above surface platform portion of said tension leg platform and further comprising a main inflation line providing communication between said inflation source and said inflation valve means.

38. The template of claim 37 wherein said main inflation line is permanently connected to said inflation valve means.

39. The template of claim 35 wherein said grout source is positioned on an above surface platform portion of said tension leg platform and further comprising a main grout line provided in communication between said grout source and said grout valve means.

40. The template of claim 39 wherein said main grout line is permanently connected to said grout valve means.

41. The template of claim 35 wherein:

said inflation valve means defines an inflation passageway therethrough;

said grout valve means defines a grout passageway therethrough;

said inflation means comprises:

a plurality of inflation pistons in said inflation passageway and movable from a first position closing an inflation discharge port to a second position opening said inflation discharge port in response to a differential pressure across said inflation piston; and said inflation pressure line provides communication between said inflation pistons and the pressure source; and said grout means comprises:

a plurality of grout pistons in said grout passageway and movable between a first position closing a grout discharge port to a second position opening said grout discharge port in response to a pressure differential across said grout piston; and said grout pressure line provides communication between said grout pistons and the pressure source.

42. The template of claim 41 wherein at least one of said pressure sources is positioned on an above surface platform portion of said tension leg platform.

43. The template of claim 41 wherein:

said inflation valve means further comprises means for preventing reverse movement of said inflation pistons; and said grout valve means further comprises means for preventing reverse movement of said grout pistons.

44. An inflation system for inflating a plurality of inflatable packers on an offshore platform, said system comprising:

a pressure actuated valve defining a central passageway therethrough in communication with an inflation source and having a plurality of discharge ports thereon, said valve further comprising means for sequentially placing said discharge ports in communication with said inflation source, said means comprising:

a plurality of piston assemblies in said central passageway, each piston assembly being movable from a position closing a discharge port to another position opening said discharge port in response to a pressure differential across said piston assembly; and first and second pressure lines providing communication between opposite sides of each of said piston assemblies and a pressure source; and a plurality of inflation lines providing communication between corresponding packers and discharge ports.

45. A grout system for grouting a plurality of annuli defined between jackets and corresponding piles of an offshore platform leg assembly, said system comprising:

a pressure actuated valve defining a central passageway therethrough in communication with a grout source and having a plurality of discharge ports thereon, said valve further comprising means for sequentially placing said discharge ports in communication with said grout source, said means comprising:

a plurality of piston assemblies in said central passageway, each piston assembly being movable from a position closing a discharge port to another position opening said discharge port in response to a pressure differential across said piston assembly; and first and second pressure lines for providing communication between opposite sides of said piston assemblies and a pressure source; and a plurality of grout lines providing communication between corresponding annuli and said discharge ports.

46. An offshore platform with an above-surface platform portion and comprising:

a plurality of jacket legs extending downwardly from said platform portion to a sea floor;

a leg pile disposed within each of said jacket legs such that a leg annulus is defined therebetween, said leg pile being driven into said sea floor;

a plurality of skirt sleeves attached to each of said jacket legs and positioned on said sea floor;

a sleeve pile disposed within each of said skirt sleeves such that a sleeve annulus is defined therebetween, said sleeve pile being driven into said sea floor;

an inflatable packer disposed at a lower end of each leg annulus and sleeve annulus;

an inflation source;

pressure actuated inflation valve means having a plurality of inflation discharge ports thereon and comprising inflation means for sequentially placing said inflation discharge ports in communication with said inflation source;

a plurality of inflation lines providing communication between corresponding packers and said inflation discharge ports;

a grout source;

pressure actuated grout valve means having a plurality of grout discharge ports thereon and comprising grout means for sequentially placing said grout discharge ports in communication with said grout source; and a plurality of grout lines providing communication between corresponding annuli and said discharge ports;

wherein, said inflation valve means and grout valve means form a single pressure actuated control valve means adapted for alternate communication with said inflation source and said grout source.

47. An offshore platform with an above-surface platform portion and comprising:

a plurality of jacket legs extending downwardly from said platform portion to a sea floor;

a leg pile disposed within each of said jacket legs such that a leg annulus is defined therebetween, said leg pile being driven into said sea floor;

a plurality of skirt sleeves attached to each of said jacket legs and positioned on said sea floor;

a sleeve pile disposed within each of said skirt sleeves such that a sleeve annulus is defined therebetween, said sleeve pile being driven into said sea floor;

an inflatable packer disposed at a lower end of each leg annulus and sleeve annulus;

an inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and first and second inflation pressure lines providing communication between opposite sides of each of said inflation pistons and a pressure source;

a plurality of inflation lines providing communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable from a first position closing a grout discharge port to a second position opening said grount discharge port in response to a pressure differential across said grout piston; and first and second grout pressure lines providing communication between opposite sides of each of said grout pistons and another pressure source; and a plurality of grout lines providing communication between corresponding annuli and said grout discharge ports.

48. A offshore platform with an above-surface platform portion and comprising:

a plurality of jacket legs extending downwardly from said platform portion to a sea floor;

a leg pile disposed within each of said jacket legs such that a leg annulus is defined therebetween, said leg pile being driven into said sea floor;

a plurality of skirt sleeves attached to each of said jacket legs and positioned on said sea floor;

a sleeve pile disposed within each of said skirt sleeves such that a sleeve annulus is defined therebetween, said sleeve pile being driven into said sea floor;

an inflatable packer disposed at a lower end of each leg annulus and sleeve annulus;

a inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and a pressure line providing communication between said inflation pistons and a pressure source; and a plurality of inflation lines providing communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable from a first position closing a grout discharge port to a second position opening said grout discharge port in response to a pressure differential across said grout piston; and a pressure line providing communication between said grout pistons and another pressure source, wherein at least one of said pressure sources is an ocean hydrostatic pressure; and a plurality of grout lines providing communication between corresponding annuli and said grout discharge ports.

49. An offshore platform with an above-surface platform portion and comprising:

a plurality of jacket legs extending downwardly from said platform portion to a sea floor;

a leg pile disposed within each of said jacket legs such that a leg annulus is defined therebetween, said leg pile being driven into said sea floor;

a plurality of skirt sleeves attached to each of said jacket legs and positioned on said sea floor;

a sleeve pile disposed within each of said skirt sleeves such that a sleeve annulus is defined therebetween, said sleeve pile being driven into said sea floor;

an inflatable packer disposed at a lower end of each leg annulus and sleeve annulus;

an inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and a pressure line providing communication between said inflation piston and a pressure source; and a plurality of inflation lines providing communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable from a first position closing a grout discharge port to a second position opening said grout discharge port in response to a pressure differential across said grout piston; and a pressure line providing communication between said grout pistons and said pressure source; and a plurality of grout lines providing communication between corresponding annuli and said grout discharge ports.

50. A template for an offshore tension leg platform, said template comprising:

a plurality of skirt sleeves positioned on a sea floor;

a sleeve pile disposed within each of said skirt sleeves such that a sleeve annulus is defined therebetween, said sleeve pile being driven into said sea floor;

an inflatable packer disposed at a lower end of each sleeve annulus;

an inflation source;

pressure actuated inflation valve means having a plurality of inflation discharge ports thereon and comprising inflation means for sequentially placing said inflation discharge ports in communication with said inflation source;

a plurality of inflation lines provided in communication between corresponding packers and said inflation discharge ports;

a grout source;

pressure actuated grout valve means having a plurality of grout discharge ports thereon and comprising grout means for sequentially placing said grout discharge ports in communication with said grout source; and a plurality of grout lines providing communication between corresponding annuli and said grout discharge ports;

wherein, said inflation valve means and said grout valve means form a single pressure actuated control valve means adapted for alternate communication with said inflation source and said grout source.

51. A template for an offshore tension leg platform, said template comprising:

a plurality of skirt sleeves positioned on a sea floor;

a sleeve pile disposed within each of said skirt sleeves such that a sleeve annulus is defined therebetween, said sleeve pile being driven into said sea floor;

an inflatable packer disposed at a lower end of each sleeve annulus;

an inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and first and second pressure lines providing communication between opposite sides of each of said inflation pistons and a pressure source; and a plurality of inflation lines provided in communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable between a first position closing a grout discharge port to a second position opening said grout discharge port in response to a pressure differential across said grout piston; and first and second pressure lines providing communication between opposite sides of each of said grout pistons and another pressure source; and a plurality of grout lines providing communication between corresponding annuli and said grout discharge ports.

52. A template for an offshore tension leg platform, said template comprising:

a plurality of skirt sleeves positioned on a sea floor;

a sleeve pile disposed within each of said skirt sleeves such that a sleeve annulus is defined therebetween, said sleeve pile being driven into said sea floor;

an inflatable packer disposed at a lower end of each sleeve annulus;

an inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and a pressure line providing communication between said inflation pistons and a pressure source; and a plurality of inflation lines providing communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable between a first position closing a grout discharge port to a second position opening said grout discharge port in response to a pressure differential across said grout pistons; and a pressure line providing communication between said grout pistons and another pressure source, wherein at least one of said pressure sources is an ocean hydrostatic pressure; and a plurality of grout lines providing communication between corresponding annuli and said grout discharge ports.

53. A template for an offshore tension leg platform, said template comprising:

a plurality of skirt sleeves positioned on a sea floor;

a sleeve pile disposed with each of said skirt sleeves such that a sleeve annulus is defined therebetween, said sleeve pile being driven into said sea floor;

an inflatable packer disposed at a lower end of each sleeve annulus;

an inflation source;

pressure actuated inflation valve means defining an inflation passageway therethrough and having a plurality of inflation discharge ports thereon, said inflation valve means further comprising inflation means for sequentially placing said inflation discharge ports in communication with said inflation source, said inflation means comprising:

a plurality of inflation pistons in said inflation passageway and movable from a first position closing an inflation discharge port to a second position opening said inflation discharge port in response to a differential pressure across said inflation piston; and a pressure line providing communication between said inflation pistons and a pressure source; and a plurality of inflation lines providing communication between corresponding packers and said inflation discharge ports;

a grout source;

pressure actuated grout valve means defining a grout passageway therethrough and having a plurality of grout discharge ports thereon, said grout valve means further comprising grout means for sequentially placing said grout discharge ports in communication with said grout source, said grout means comprising:

a plurality of grout pistons in said grout passageway and movable between a first position closing a grout discharge port to a second position opening said grout discharge port in response to a pressure differential across said grout pistons; and a pressure line providing communication between said grout pistons and said pressure source; and a plurality of grout lines providing communication between corresponding annuli and said grout discharge ports.

54. An inflation system for inflating a plurality of inflatable packers on an offshore platform, each of said packers being disposed in an annulus defined between a jacket and a pile of corresponding legs and skirts of said offshore platform, said system comprising:

a first pressure actuated valve having a plurality of discharge ports thereon and comprising means for sequentially placing said discharge ports on said first valve in communication with an inflation source;

a plurality of inflation lines providing communication between corresponding packers and discharge ports on said first valve;

a pressure line providing communication between said means and a pressure source separate from said inflation source;

a second pressure actuated valve having a plurality of discharge ports thereon and comprising means for sequentially placing said discharge ports on said second valve in communication with a grout source; and a plurality of grout lines providing communication between corresponding annuli and discharge ports on said second valve.

55. A grout system for grouting a plurality of annuli defined between jackets and corresponding piles of an offshore platform leg assembly wherein an inflatable packer is disposed in a lower end of each of said annuli, said system comprising:

a first pressure actuated valve having a plurality of discharge ports thereon and comprising means for sequentially placing said discharge ports on said first valve in communication with a grout source;

a plurality of grout lines providing communication between corresponding annuli and said discharge ports on said first valve;

a pressure line for providing communication between said means and a pressure source separate from said grout source;

a second pressure actuated valve having a plurality of discharge ports thereon and comprising means for sequentially placing said discharge ports on said second valve in communication with an inflation source; and a plurality of inflation lines providing communication between corresponding packers and discharge ports on said second valve.

* * * * *

UNITED STATES PATENT AND TRADEMARK OFFICE

CERTIFICATE OF CORRECTION

PATENT NO. : 4,826,356

DATED : May 2, 1989

INVENTOR(S) : David P. Brisco

It is certified that error appears in the above-identified patent and that said Letters Patent is hereby corrected as shown below:

In column 9, line 64, delete the numeral [775] and insert therefore --275--.

Signed and Sealed this

Twentieth Day of March, 1990

*Attest:*

JEFFREY M. SAMUELS

*Attesting Officer*

*Acting Commissioner of Patents and Trademarks*